US009412540B2

(12) United States Patent
Takemoto et al.

(10) Patent No.: US 9,412,540 B2
(45) Date of Patent: Aug. 9, 2016

(54) SWITCH

(71) Applicants: Tomohiko Takemoto, Tokyo (JP); Takashi Inaguchi, Tokyo (JP)

(72) Inventors: Tomohiko Takemoto, Tokyo (JP); Takashi Inaguchi, Tokyo (JP)

(73) Assignee: MITSUBISHI ELECTRIC CORP., Tokyo (JP)

( * ) Notice: Subject to any disclaimer, the term of this patent is extended or adjusted under 35 U.S.C. 154(b) by 0 days.

(21) Appl. No.: 14/406,558

(22) PCT Filed: Nov. 12, 2012

(86) PCT No.: PCT/JP2012/007221

§ 371 (c)(1),
(2) Date: Dec. 9, 2014

(87) PCT Pub. No.: WO2014/073026

PCT Pub. Date: May 15, 2014

(65) Prior Publication Data

US 2015/0129549 A1 May 14, 2015

(51) Int. Cl.

*H01H 33/20* (2006.01)
*H01H 9/46* (2006.01)
*H01H 50/00* (2006.01)
(Continued)

(52) U.S. Cl.

CPC ..... *H01H 33/20* (2013.01); *H01H 9/46* (2013.01); *H01H 50/002* (2013.01); *H01H 50/546* (2013.01); *H01H 2050/028* (2013.01)

(58) Field of Classification Search

CPC ..... H01H 9/32; H01H 9/46; H01H 33/20; H01H 33/60; H01H 73/18; H01H 50/002; H01H 50/546

USPC ..... 218/148, 36, 40; 335/133, 201, 202, 335/132

See application file for complete search history.

(56) References Cited

U.S. PATENT DOCUMENTS 4,616,203 A * 10/1986 Kakizoe ..... H01H 9/342 335/201
4,642,429 A * 2/1987 Mori ..... H01H 9/36 218/151

(Continued)

FOREIGN PATENT DOCUMENTS

CN 1327604 A 12/2001
JP 55-081232 U 6/1980
JP 57-168128 U 10/1982

(Continued)

OTHER PUBLICATIONS

Translation JP 01-189833.*

(Continued)

*Primary Examiner* — Renee Luebke
*Assistant Examiner* — William Bolton
(74) *Attorney, Agent, or Firm* — Sughrue Mion, PLLC

(57) ABSTRACT

A small-size switch having an arc runner is provided. The switch includes fixed contacts each of which is bonded with each one end of fixed contactors 6U; movable contacts 10U each of which is bonded with each of movable contactors 9 and each of which can contact with or leave from each of the fixed contacts; an interphase barrier 80 that is disposed so as to partition the movable contacts 10U one by one and that is an insulator; and an arc runner that has an arc extinguish portion 12A and that is disposed so as not to intrude in a space where the interphase barrier 80 and the movable contactor 9 are most closely located.

8 Claims, 9 Drawing Sheets

(51) Int. Cl.
*H01H 50/54* (2006.01)
*H01H 50/02* (2006.01)

(56) References Cited

U.S. PATENT DOCUMENTS 4,652,707 A * 3/1987 Mori ..... H01H 9/46 218/148
5,844,457 A * 12/1998 Eckroth ..... H01H 50/64 335/132

FOREIGN PATENT DOCUMENTS

JP 59-112513 A 6/1984
JP 59-181421 A 10/1984
JP 01-109155 U 7/1989
JP 01-112542 U 7/1989
JP 01-189833 * 7/1989 ..... H01H 9/46
JP 06-223669 A 8/1994
JP 09-270223 A 10/1997
JP 11-339581 A 12/1999

OTHER PUBLICATIONS

International Search Report for PCT/JP2012/007221 dated Dec. 4, 2012 [PCT/ISA/210].
Communication issued on Jan. 19, 2016 by the Korean Intellectual Property Office in related Application No. 10-2015-7001764.
Office Action dated Oct. 26, 2015, issued by the Korean Intellectual Property Office in counterpart Korean Application No. 10-2015-7001764.
Office Action dated Feb. 15, 2016, issued by the State Intellectual Property Office of the People's Republic of China in counterpart Chinese Application No. 201280075038.4.

* cited by examiner

SWITCH

CROSS REFERENCE TO RELATED APPLICATIONS

This application is a National Stage of International Application No. PCT/JP2012/007221 filed Nov. 12, 2012, the contents of all of which are incorporated herein by reference in their entirety.

TECHNICAL FIELD

The present invention relates to a switch that includes a movable contact bonded with a movable contactor, a fixed contact bonded with a fixed contactor, and an arc runner.

BACKGROUND ART

A switch includes movable contacts bonded with both ends of a movable contactor, and a fixed contact bonded with an end of a fixed contactor and located to face each of the movable contacts, and an arc is generated between the movable contact and the fixed contact when current is cut off. The arc shortens the electrical life of switch, and degrades insulation performance of molded parts used for interphase insulation thereby provoking the interphase short circuit. Therefore, an arc runner serving as an arc-extinguishing metal plate for attracting the arc to promptly extinguish it is provided in some of the switches.

Specifically, there has been a switch that includes a first arc runner and a second arc runner (for example, see Patent Document 1). The first arc runner has a U-shape portion in which an opening is provided at a contact side for shielding between a fixed contact and a movable contact, and also has an expanded portion which is extended in a fixed contactor side of the U-shape portion by the intervention of a bent step portion. The second arc runner is provided to stand in parallel with the expanded portion of first arc runner so as to cover the neighborhood of fixed contactor tip. In addition, an arc runner is disclosed which is configured with a gutter-shaped curved surface or multiple surfaces in which an angle between the neighboring surfaces is an obtuse angle and which is disposed in parallel with a contact or leave direction so that a depressed portion of the curved surface or multiple surfaces faces the movable contactor end portion (for example, see Patent Document 2).

PRIOR ART DOCUMENT

Patent Document

Patent Document 1: Japanese Unexamined Patent Application Publication No. S59-112513 (P. 2-P. 3, FIG. 4, FIG. 5)

Patent Document 2: Japanese Unexamined Patent Application Publication No. S59-181421 (P. 2-P. 3, FIG. 7, FIG. 9)

SUMMARY OF THE INVENTION

Problem that the Invention is to Solve

In a conventional arc runner, part of the arc runner is disposed at a space between a movable contact and interphase barriers which are insulators disposed at both right and left sides of the movable contact. Thus, only a large-size switch which has some space between the interphase barrier and the movable contact can equip the arc runner. On the other hand, since a downsized switch, especially the one having a downsized width, has a small space between the interphase barrier and the movable contact, an open space large enough to dispose the arc runner cannot be secured. Therefore, in a case where a model that needs an arc runner is to be downsized, it is necessary to remove the arc runner, and thus problems occur that the electrical life is shortened and degradation of insulation performance of molded parts used for interphase insulation provokes the interphase short circuit.

In order to solve the above-described problems, an objective of the present invention is to provide a small-size switch that includes an arc runner.

Means for Solving the Problem

A switch according to the present invention includes fixed contacts each of which is bonded with each one end of fixed contactors; movable contacts each of which is bonded with each of movable contactors and each of which can contact with or leave from each of the fixed contacts; an interphase barrier that is disposed so as to partition the movable contacts one by one and that is an insulator; and an arc runner that has an arc extinguish portion, that is disposed so as not to intrude in a space where the interphase barrier and the movable contactor are most closely located, and that has the arc extinguish portion.

Advantageous Effects of the Invention

In the present invention, an arc runner is disposed along an operating direction of a movable contact so as not to laterally overlap with interphase barriers which are insulators disposed at both right and left sides of the movable contact, thereby enabling the downsizing of a switch that includes an arc runner.

MODE FOR CARRYING OUT THE INVENTION

Embodiment 1

Figure 1:
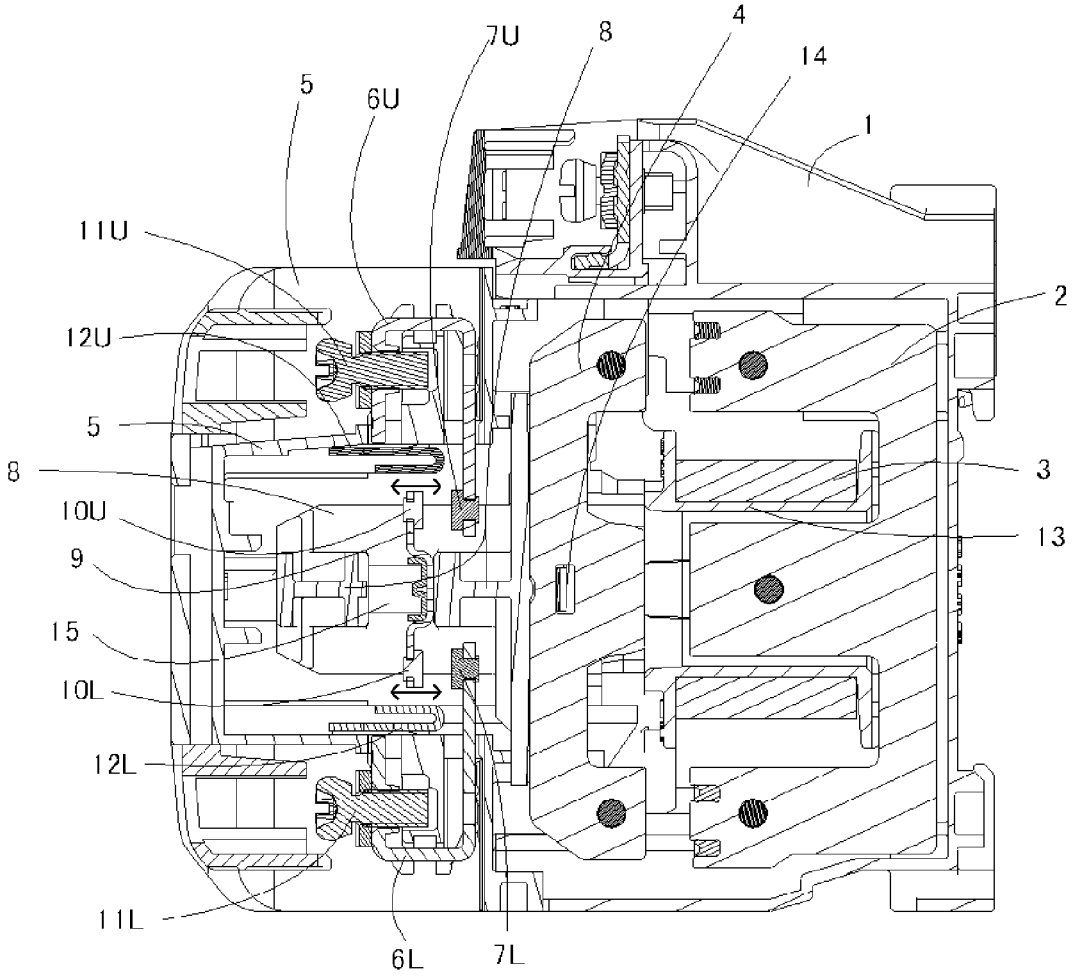
FIG. 1 is a lateral cross-sectional view of a switch in Embodiment 1 of the present invention.

FIG. 1 is a lateral cross-sectional view of a switch. The left side of the figure is a front side of the switch, and the right side of figure is a rear side of switch. The exterior of the switch in the present invention is formed by a rear case 1 and a case 5 which are insulators manufactured by plastic molding, for example. In the rear case 1, there are provided a fixed iron core 2 having an E-shape, an electromagnetic coil 3 and a coil bobbin 13 which are disposed to circle around the fixed iron core 2, and a movable iron core 4, having the E-shape, disposed at a position facing the fixed iron core 2.

The inside of case 5 has a vertically symmetric structure, and there are disposed a movable contactor carrier 8, fixed contactors 6U and 6L, screws 11U and 11L, a movable contactor 9, and arc runners 12U and 12L. The movable iron core 4 is connected, via a movable iron core connection plate 14, to the movable contactor carrier 8 being a molded part, and the movable contactor 9 is held so that the center portion thereof is pressed against the movable contactor carrier 8 by a forcing spring 15 interposed into a holding hole of movable contactor carrier 8. While the structure of the upper side will be explained hereinafter, that of the lower side is similarly obtained by replacing the suffix "U" with "L". The fixed contactor 6U is mounted to the case 5 at a rear side of the switch relative to the movable contactor 9, and a fixed contact 7U bonded with an end of the fixed contactor 6U can contact with or leave from a movable contact 10U bonded with either end of the movable contactor 9 in its longitudinal direction. There is a hole at the other end of the fixed contactor 6U, and the screw 11U for connecting to a terminal of an external device is inserted to the hole. The arc runner 12U being a metal plate is fixed to the case 5 and is disposed, at an end portion side of the movable contactor 9, along an operating direction of the movable contactor 9 (direction indicated by arrows) so as to face the movable contact 10U. Note that a general switch has a structure in which a plurality of movable contactors, fixed contactors, etc. is arranged in a direction perpendicular to the sheet of FIG. 1 (transverse direction).

Figure 2:
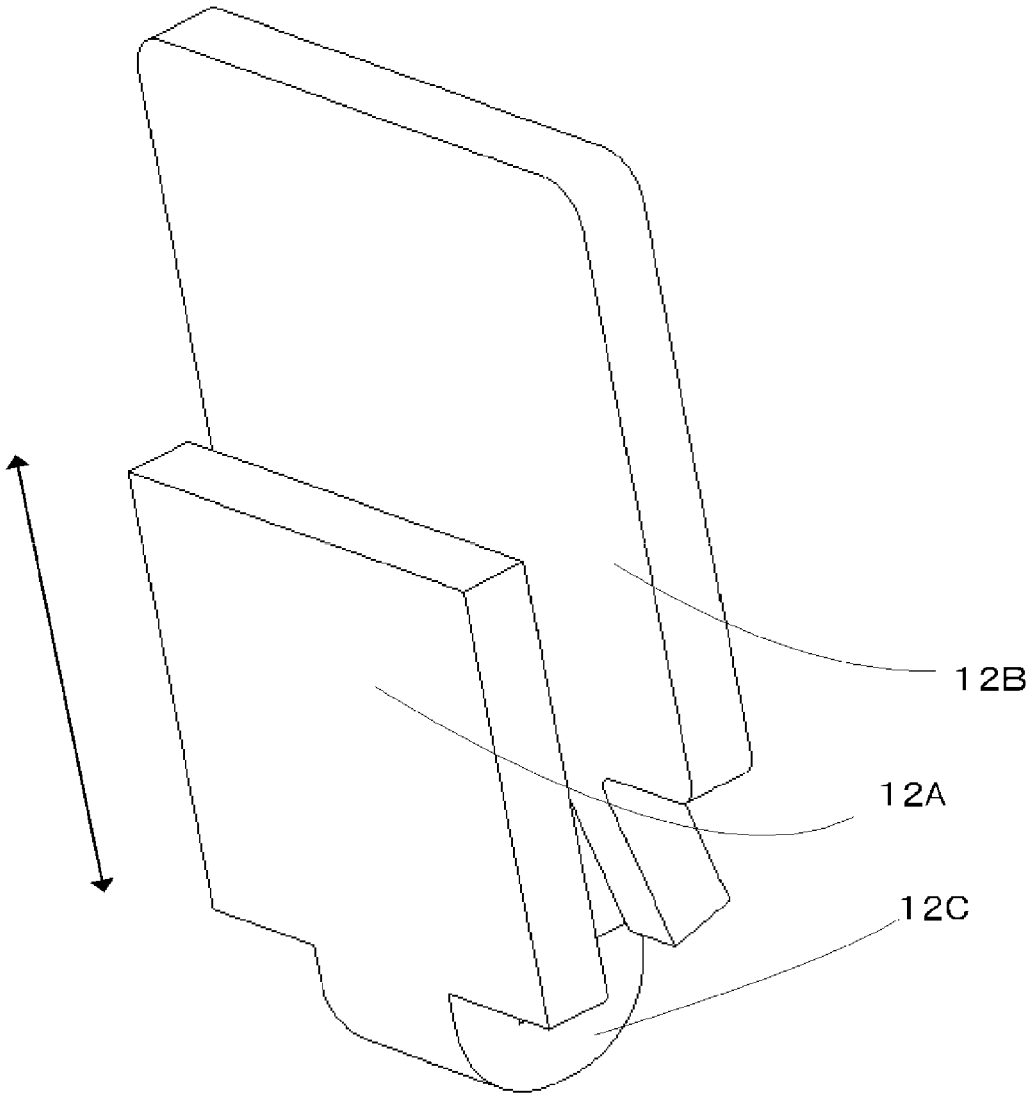
FIG. 2 is a perspective view of an arc runner according to the switch in Embodiment 1 of the present invention.

FIG. 2 is a perspective view of an arc runner 12 according to Embodiment 1. The arc runner 12 is configured with an arc extinguish portion 12A for attracting the arc, a heat radiation portion 12B for dissipating arc heat, and a U-shaped portion 12C for bonding the arc extinguish portion 12A with the heat radiation portion 12B. In this embodiment, the arc extinguish portion has a plate-like shape. The arc runner 12 is fixed to the case 5 by the heat radiation portion 12B. The heat radiation portion 12B has a shape whose side length along an operating direction of the movable contact 10 (direction indicated by arrows) is longer than the length of arc extinguish portion 12A. Thus, a heat radiation effect is increased and an arc can be promptly extinguished.

Figure 3:
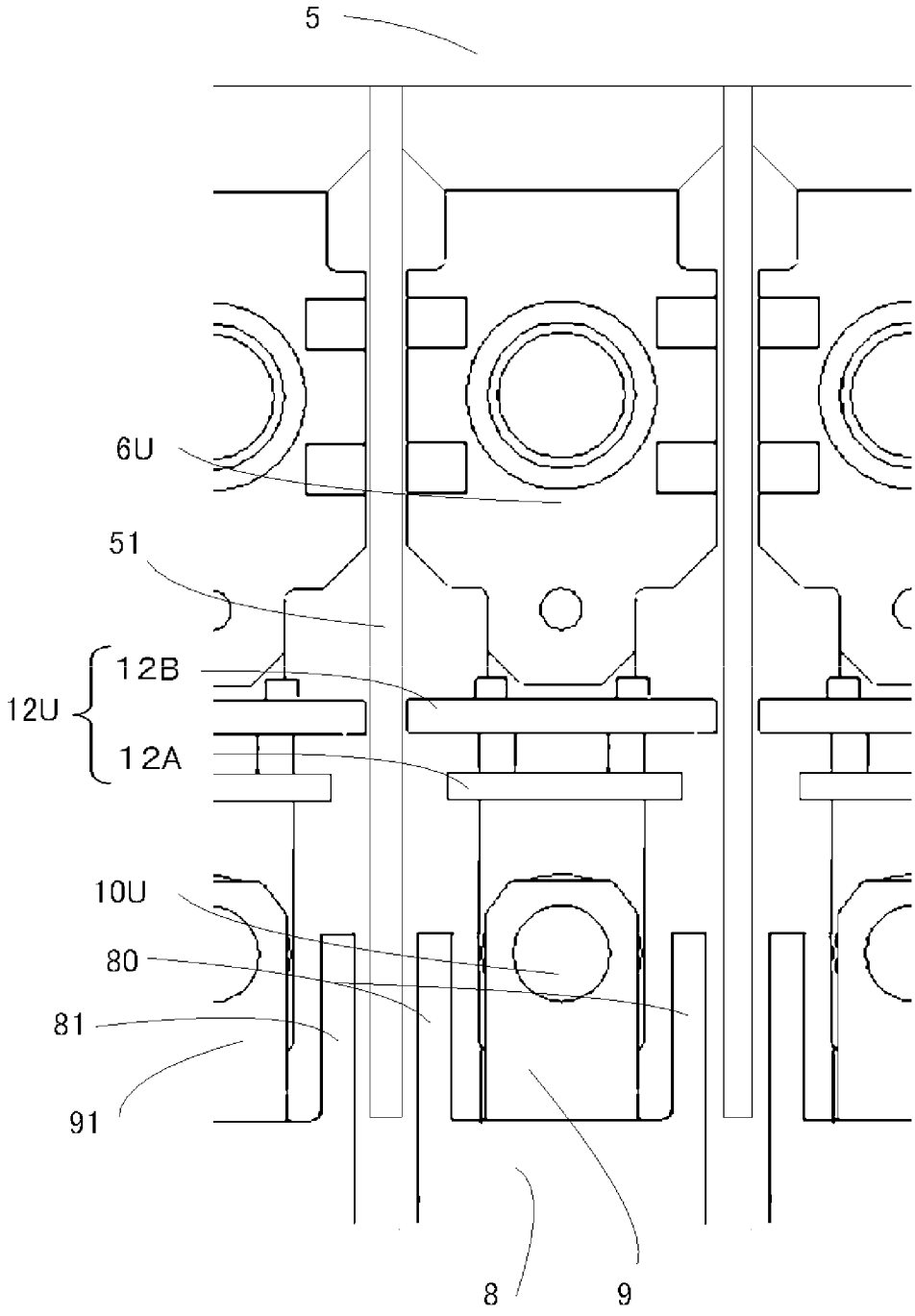
FIG. 3 is a front view of a movable contactor, a movable contact, a fixed contactor, a movable contactor carrier, and the arc runner in the switch in Embodiment 1 of the present invention.

FIG. 3 is a front view of the fixed contactor 6U, case 5, arc runner 12U, movable contactor 9, movable contact 10U, and movable contactor carrier 8 disposed at the upper half of FIG. 1. Since the fixed contactor 6L, case 5, arc runner 12L, movable contactor 9, movable contact 10L, and movable contactor carrier 8 disposed at the lower half of FIG. 1 has the similar structure of being turned upside down, only the upper side will be explained here. As shown in FIG. 3, the movable contactor carrier 8 has a pair of partition portions 80, each of which partitions the movable contactor 9 from a neighboring movable contactor 91, at the right and left sides of movable contactor 9 so as to be adjacent thereto. The partition portion 80 of movable contactor carrier 8 protrudes from the center portion of movable contactor 9 toward the end portion thereof so as to sandwich the movable contactor 9. Also, in the case 5 being a molded part same as the movable contactor carrier 8, a partition portion 51 is provided and disposed, in an alternate manner, to be sandwiched by the partition portion 80 and the partition portion 81 adjacent to the neighboring movable contactor 91. The partition portions 80, 81 of movable contactor carriers 8 and the partition portion 51 of case 5 partition the movable contacts one by one, and function as interphase barriers. In a small-size model, an open space, surrounded by the partition portions 80 of movable contactor carrier 8 and the partition portions 51 of case 5, where the movable contactor 9 is disposed is small, and especially the partition portion 80 of movable contactor carrier 8 is located in proximity to the movable contactor 9.

In the present invention, the arc runner 12U is disposed so as not to laterally overlap with the partition portion 80 of movable contactor carrier 8. Or, the arc runner 12U is disposed so as not to overlap with the interphase barrier 80 at a position where the interphase barrier 80 and the movable contact 10U are most closely located laterally. Here, "laterally" means a direction perpendicular to both the longitudinal direction of movable contactor 9 and the operating direction of movable contactor 9, and is a direction perpendicular to the sheet of FIG. 1. Or, it is a direction in which a plurality of movable contacts is arranged, and is a right and left direction with respect to the sheet of FIG. 3. It can be expressed also as a direction in which the partition portion 80 of movable contactor carrier 8 and the movable contactor 9 are adjacently disposed. Namely, the arc runner 12U is disposed at the end portion side (upper side in FIG. 3) of movable contactor 9 relative to the partition portion 80 of movable contactor carrier 8. In other words, the arc runner 12U is disposed so that part of the arc runner 12U does not intrude in an open space where the movable contactor 9 and the partition portion 80 of movable contactor carrier 8 are most closely located. Thus, even in a small-size switch in which an arc runner cannot be disposed between the movable contactor 9 and the partition portion 80 of movable contactor carrier 8, an arc runner can be disposed similar to a conventional large-size model.

Next, an operation will be explained with reference to FIG. 1. While the operation in the upper side will be explained, that of the lower side is similarly obtained by replacing the suffix "U" with "L", since the inside of case 5 has a vertically symmetric structure. When voltage is applied to the electromagnetic coil 3, the movable iron core 4 is attracted by the fixed iron core 2, and the movable contactor carrier 8, movable contactor 9, and movable contact 10U are also attracted toward a fixed iron core side, and thus the movable contact 10U contacts the fixed contact 7U. If the fixed contact 7U contacts the movable contact 10U, current flows through the screw 11U, fixed contactor 6U, fixed contact 7U, movable contact 10U, and movable contactor 9, and the movable contactor 9, movable contact 10L, fixed contact 7L, fixed contactor 6L, and screw 11L become a conduction state. Since the screw 11U is connected to a terminal of an external device, current flows the external device. When excitation of the electromagnetic coil 3 is stopped, the fixed iron core 2 is separated from the movable iron core 4 and the movable contact 10U is separated from the fixed contact 7U by return spring (not shown) force, and an arc is generated between the contacts. Since the arc shortens the electrical life of switch and causes the interphase short circuit brought by insulation performance degradation of movable contactor carrier 8 and case 5 used for interphase insulation, it is necessary to extinguish the arc promptly.

Figure 4:
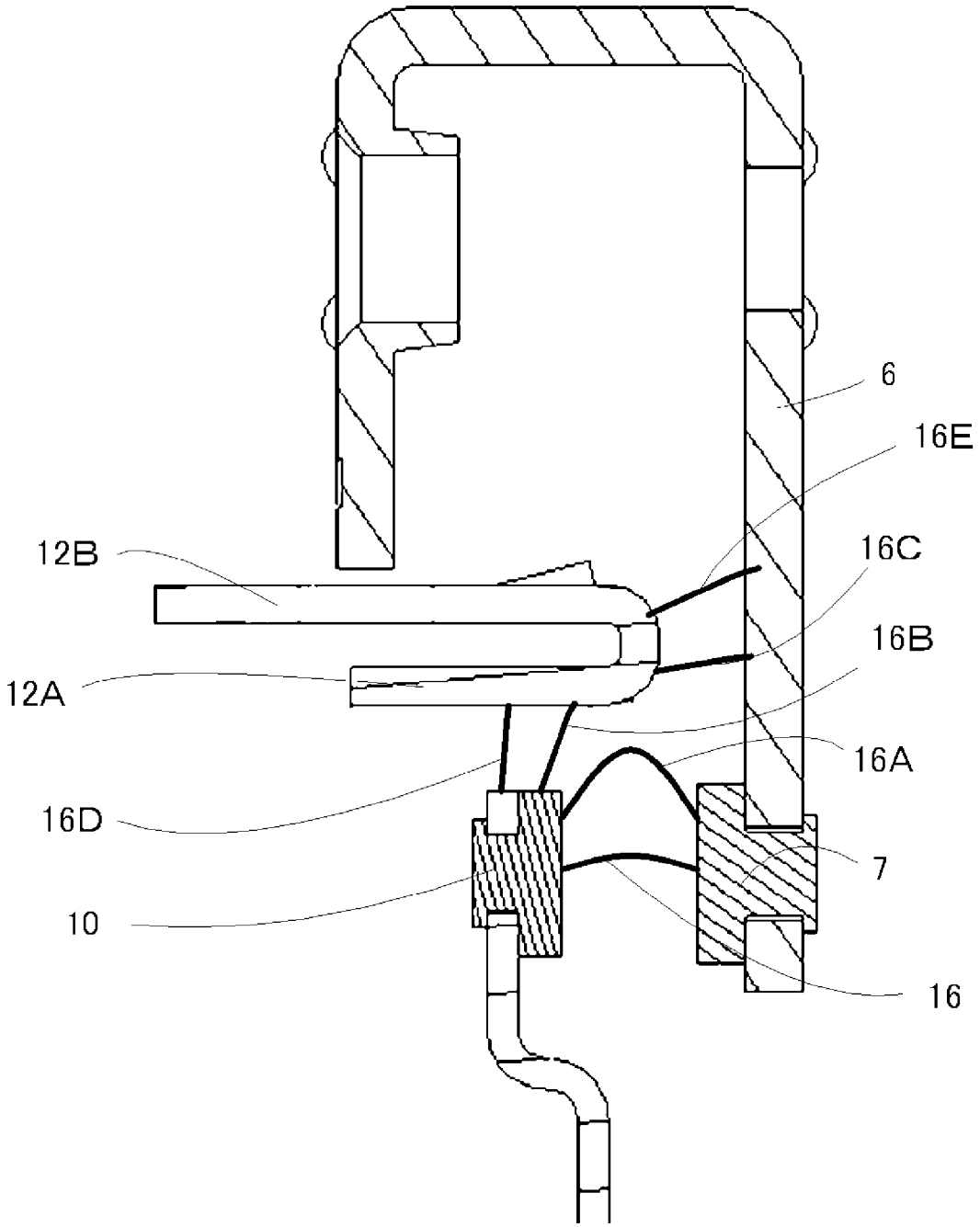
FIG. 4 is an enlarged lateral cross-sectional view of part of the switch according to Embodiment 1 of the present invention.

Next, an operation of an arc will be explained with reference to FIG. 4. FIG. 4 is an enlarged view of part of FIG. 1 (fixed contactor 6, fixed contact 7, movable contactor 9, movable contact 10, and arc runner 12). An arc 16 generated between the movable contact 10 and the fixed contact 7 is attracted to the arc extinguish portion 12A of arc runner 12, and becomes an arc 16A. The arc 16A is further attracted to the arc extinguish portion 12A, and is separated into an arc 16B and an arc 16C. The arc 16B and the arc 16C are respectively moved to the front side and the upper side by driving force of a magnetic field generated by current flowing through the arc runner 12, and become an arc 16D and an arc 16E. Thus, since the arc 16 is separated into the arc 16D and the arc 16E, the arc is cooled and the arc voltage is increased so that the arc can be extinguished.

Thus, since the arc runner 12 is shaped and disposed so as not to laterally overlap with the movable contactor carrier 8, an arc runner can be equipped even in a small-size switch not having enough space between the movable contactor carrier 8 and the movable contactor 9, as shown in FIG. 3. Also, since the heat radiation portion 12B dissipates the arc heat generated by the arc, the increase in arc voltage can be accelerated, so that the arc can be promptly extinguished. In addition, since the side length, along the operating direction of movable contact 10, of heat radiation portion 12B is longer than the length of arc extinguish portion 12A, the arc can be more promptly extinguished. Note that, in a small-size low-current model, the arc runner 12 may have a structure without the U-shaped portion 12C and heat radiation portion 12B. That is, whether or not the U-shaped portion 12C and heat radiation portion 12B are necessary can be determined depending on the performance of the model. If determined to be unnecessary, only the arc extinguish portion 12A is needed to be disposed, thereby enabling downsizing also in the vertical direction. In this case, the arc extinguish portion 12A of arc runner 12 may be fixed to the case 5.

Embodiment 2

The difference between this embodiment and Embodiment 1 is that no partition portion 80 of movable contactor carrier 8 is provided next to the movable contactor 9 and only the partition portion 51 of case 5 is provided, and the other configuration is the same as that in Embodiment 1. The arc runner 12U is disposed so as not to laterally overlap with the movable contactor 9. That is, the arc runner 12U is disposed so as not to laterally overlap with the movable contactor 9 in a direction in which the partition portion 51 of case 5 and the movable contactor 9 are adjacently disposed. Or, the arc runner 12U is disposed so that part of the arc runner 12U does not intrude between the movable contactor 9 and the partition portion 51 of case 5. Namely, the arc runner 12 is disposed, without contacting the movable contactor 9, at an end portion side in a longitudinal direction of the movable contactor 9. Thus, compared to Embodiment 1, a switch can be further downsized by the width of partition portion 80 of movable contactor carrier 8.

Embodiment 3

Figure 5:
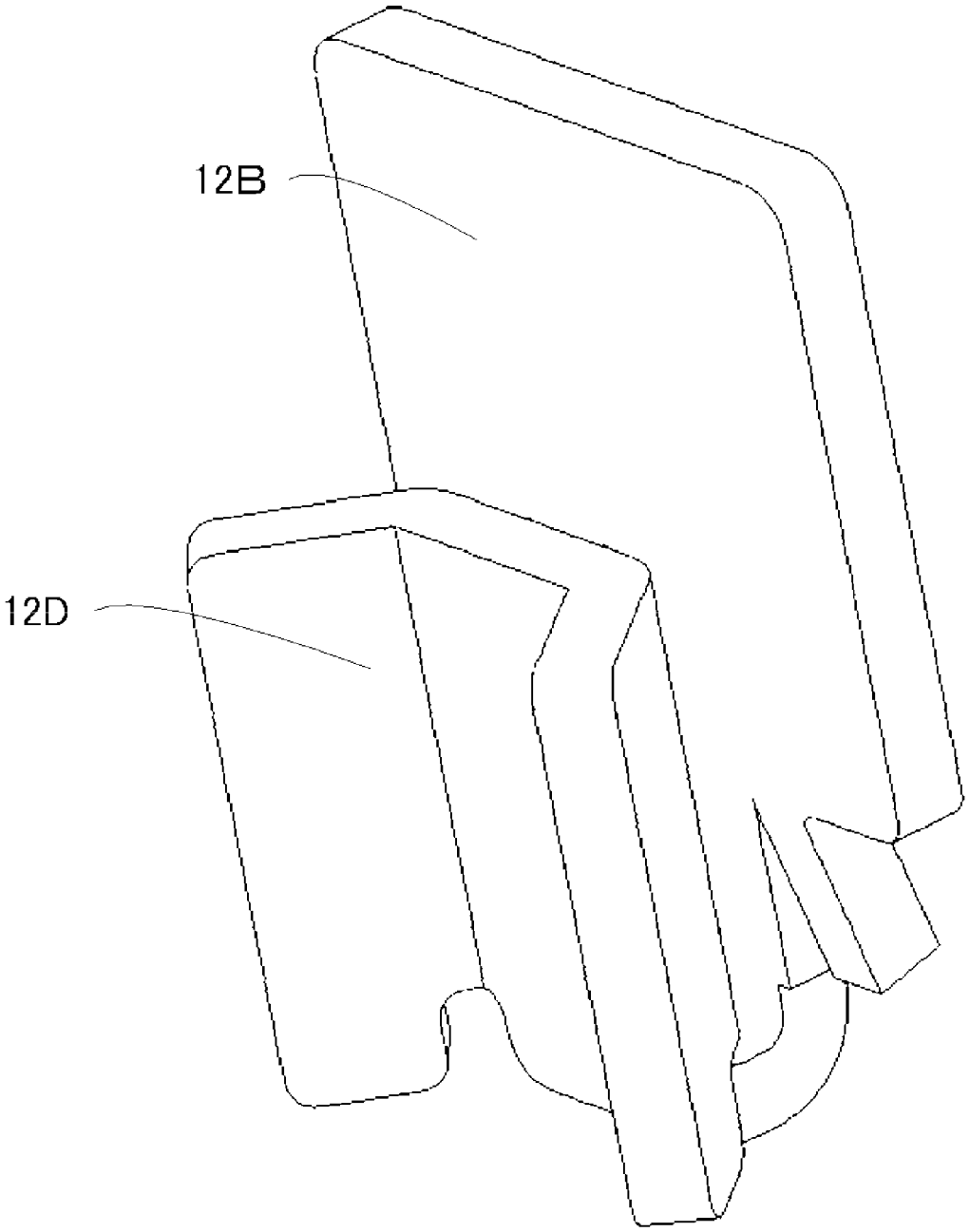
FIG. 5 is a perspective view of an arc runner according to a switch in Embodiment 3 of the present invention.
Figure 6:
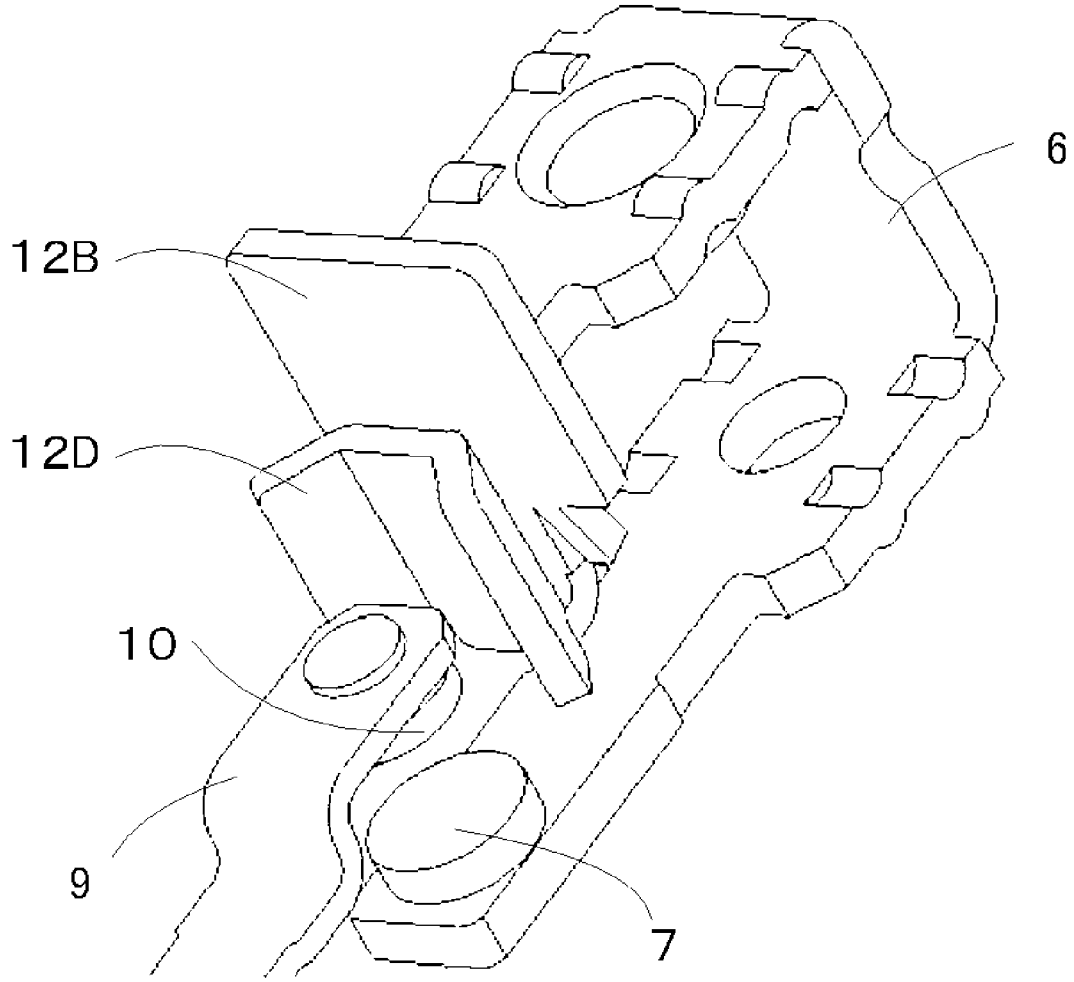
FIG. 6 is a perspective view of a movable contactor, a movable contact, a fixed contactor, a fixed contact, and the arc runner in the switch in Embodiment 3 of the present invention.
Figure 7:
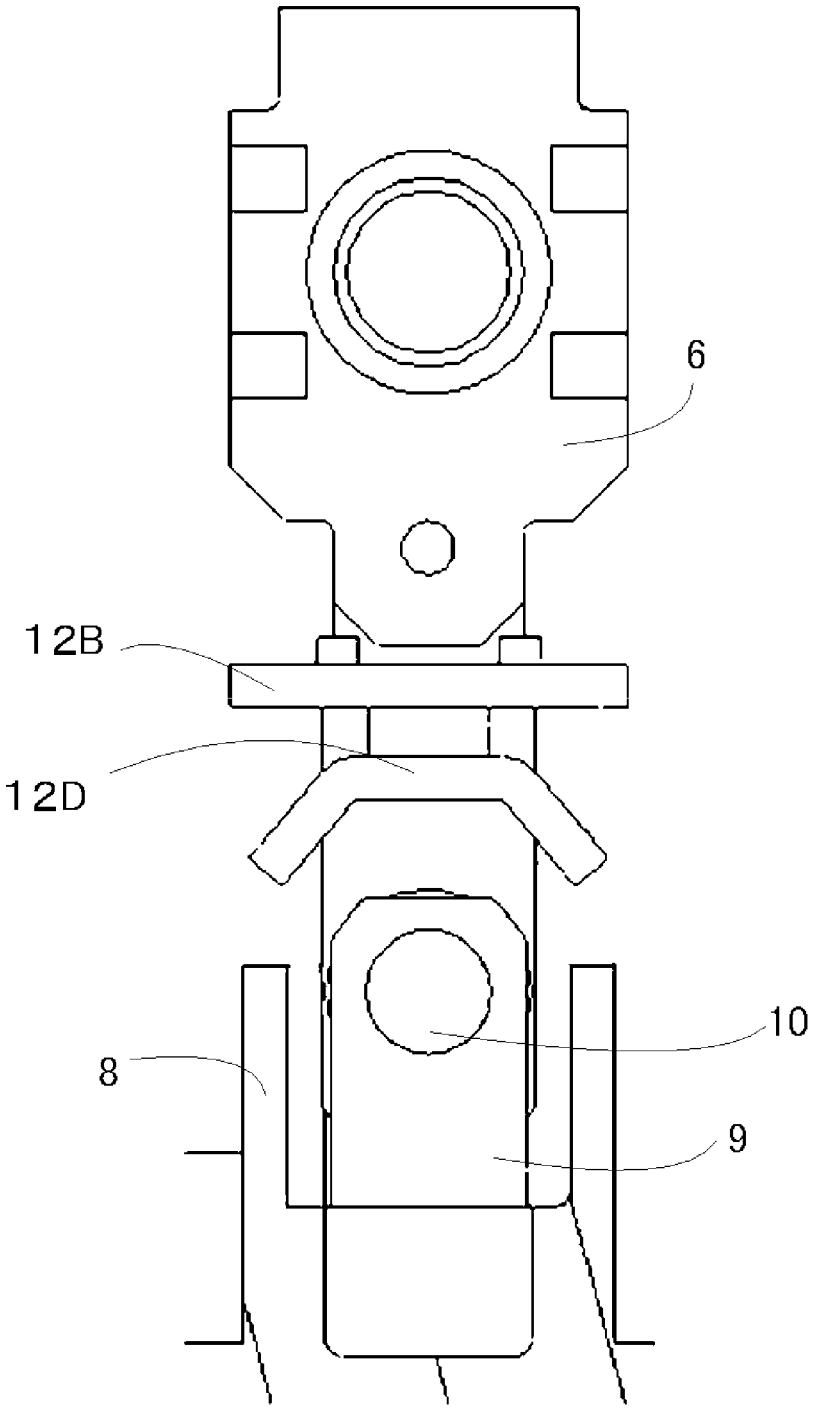
FIG. 7 is a front view of the movable contactor, the movable contact, the fixed contactor, a movable contactor carrier, and the arc runner in the switch in Embodiment 3 of the present invention.

FIG. 5 is a perspective view of the arc runner 12 according to Embodiment 3. The only difference between this embodiment and Embodiment 1 is the shape of arc runner 12, and the arc extinguish portion 12A in Embodiment 1 is replaced by an arc extinguish portion 12D configured with gutter-shaped multiple surfaces in which an angle between the neighboring surfaces is an obtuse angle. The other configuration and the operation of switch are similar to those in Embodiment 1. FIG. 6 is a perspective view of the movable contactor 9, movable contact 10, fixed contactor 6, fixed contact 7, and arc runner 12, and a depression of the arc extinguish portion 12D is disposed so as to face the movable contact. FIG. 7 is a front view of the fixed contactor 6, arc runner 12, movable contactor 9, movable contact 10, and movable contactor carrier 8, and single movable contactor 9 is only illustrated. The arc runner 12 is disposed, along an operating direction of the movable contact 10 (direction perpendicularly penetrating a plane in the figure), so as not to laterally overlap with the movable contactor carrier 8.

By employing such a configuration, in addition to the effects similar to those in Embodiment 1, the arc can be more promptly extinguished since the distance between the movable contactor 9 and each of end portions of arc extinguish portion 12D becomes short. Note that, similar to Embodiment 1, the arc runner 12 may have a structure without the U-shaped portion 12C and heat radiation portion 12B depending on the performance of a switch. Here, the effects obtained in a case where the arc runner 12 has the structure without the U-shaped portion 12C and heat radiation portion 12B are similar to those in Embodiment 1 or Embodiment 2, and the arc runner 12 may be attached by fixing the arc extinguish portion 12D to the case 5.

Embodiment 4

Figure 8:
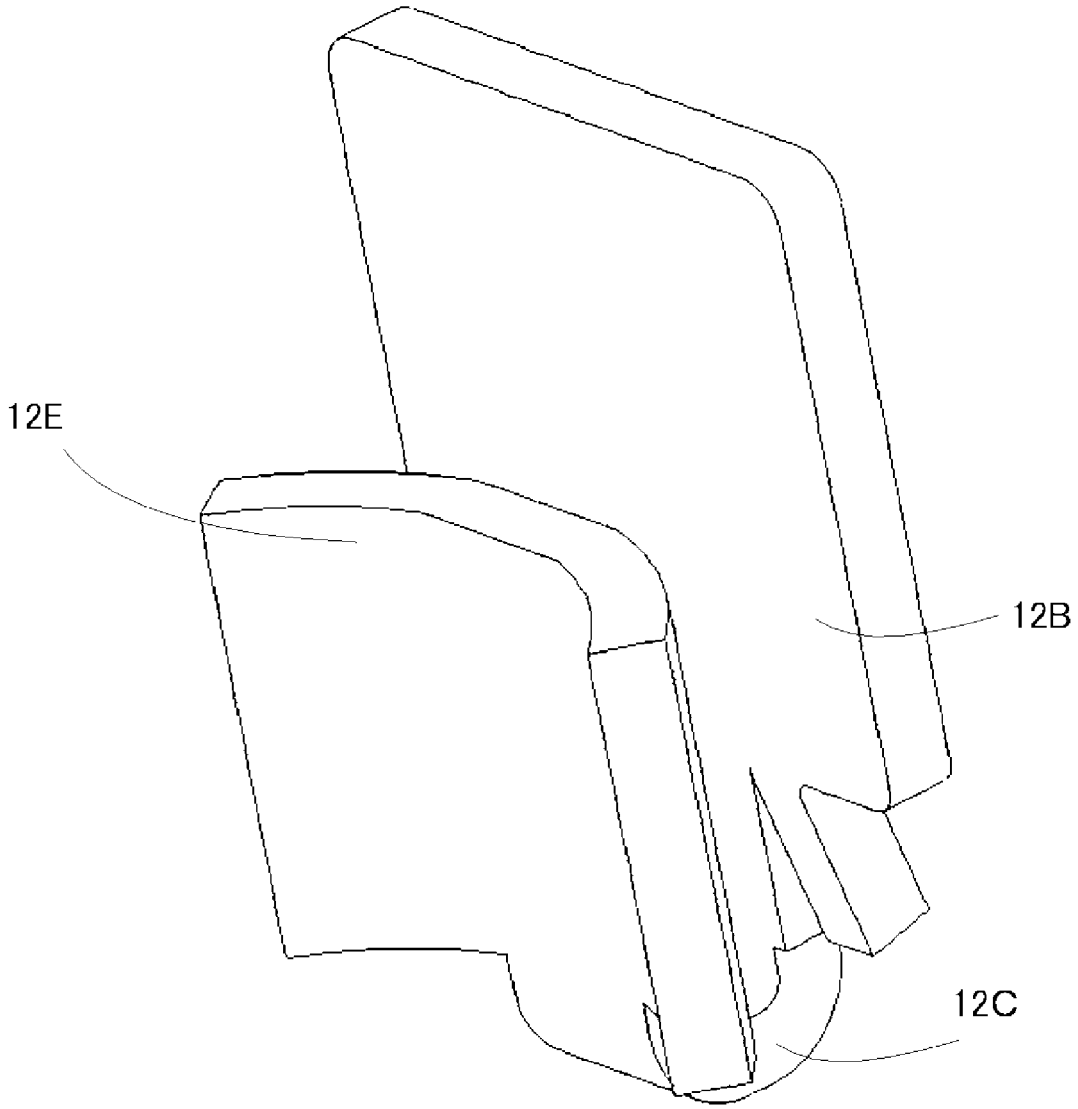
FIG. 8 is a perspective view of an arc runner according to a switch in Embodiment 4 of the present invention.

FIG. 8 is a perspective view of the arc runner 12 according to Embodiment 4. The only difference between this embodiment and Embodiment 1 is the shape of arc runner 12, and the arc extinguish portion 12A in Embodiment 1 is replaced by an arc extinguish portion 12E configured with a gutter-shaped curved surface. The other configuration and the operation of switch are similar to those in Embodiment 1. Also in this case having such a shape, similar to Embodiment 2, the arc can be more promptly extinguished since the distance between the movable contactor 9 and each of end portions of arc extinguish portion 12E becomes short. Note that, similar to Embodiments 1 and 2, the necessity of U-shaped portion 12C and heat radiation portion 12B can be determined depending on the performance of a model, and only the extinguish portion 12E may be provided if determined to be unnecessary. In such a case, the arc runner 12 may be attached by fixing the arc extinguish portion 12E to the case 5.

Embodiment 5

Figure 9:
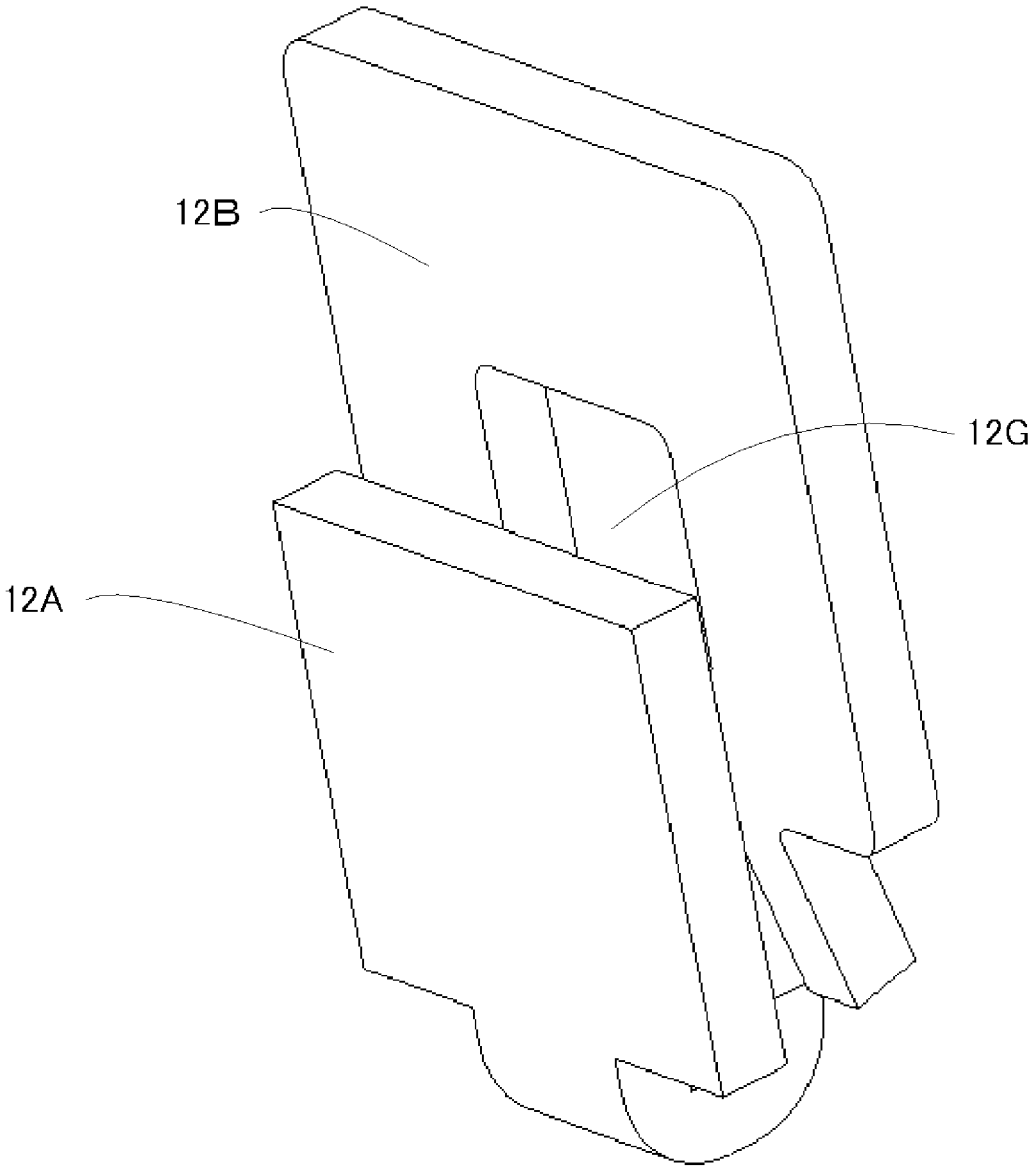
FIG. 9 is a perspective view of an arc runner according to a switch in Embodiment 5 of the present invention.

FIG. 9 is a perspective view of an arc runner according to a switch in Embodiment 5. In this embodiment, a structure is employed in which an opening 12G is provided at the heat radiation portion 12B in Embodiments 1 through 3, as shown in FIG. 9, and the other portions are similar to those in Embodiments 1 through 3. In this case, the arc gas generated between the movable contact 10 and the fixed contact 7 is discharged to the outside through the opening 12G. Since the arc can be easily cut off by the discharge of arc gas, the arc is promptly extinguished. By employing such a configuration, in addition to the effects similar to those in Embodiments 1 through 3, the arc can be more promptly extinguished. Note that, while FIG. 9 shows a case, as an example, where an opening is provided to the structure in Embodiment 1, an opening may be provided at the heat radiation portion 12B in Embodiment 2 or 3.

REFERENCE NUMERALS

6 fixed contactor; 7 fixed contact; 8 movable contactor carrier; 9 movable contactor; 10 movable contact; and 12 arc runner.

The invention claimed is:

1. A switch comprising:

a plurality of fixed contacts bonded with respective ends of a plurality of fixed contactors;

a plurality of movable contacts bonded respectively with a plurality of movable contactors, and the plurality of movable contacts can respectively contact with and leave from the plurality of fixed contacts;

an interphase barrier comprising a partition plate in between the plurality of movable contactors which protrudes from a center portion of the plurality of movable contactors toward an end portion of the plurality of movable contactors, the partition plate is disposed so as to partition the plurality of movable contacts one by one, and the partition plate is an insulator;

an arc runner comprising an arc extinguish portion that is disposed so as not to intrude in a space where the interphase barrier and the movable contactor are most closely located, wherein the arc runner is disposed in a direction from the center portion toward the end portion relative to an end portion of the partition plate.

2. The switch in claim 1, wherein the arc extinguish portion is configured with gutter-shaped multiple surfaces in which an angle between the neighboring surfaces is an obtuse angle or a gutter-shaped curved surface.

3. The switch in claim 2, wherein the arc runner further includes a heat radiation portion and a U-shaped portion that parallelly connects the arc extinguish portion and the heat radiation portion.

4. The switch in claim 3, wherein a side length, along an operating direction of the movable contact, of the heat radiation portion is longer than a length of the arc extinguish portion.

5. The switch in claim 1, wherein the arc runner further includes a heat radiation portion and a U-shaped portion that parallelly connects the arc extinguish portion and the heat radiation portion.

6. The switch in claim 5, wherein a side length, along an operating direction of the movable contact, of the heat radiation portion is longer than a length of the arc extinguish portion.

7. The switch in claim 6, wherein an opening is provided at the heat radiation portion of the arc runner.

8. The switch in claim 5, wherein an opening is provided at the heat radiation portion of the arc runner.

* * * * *